United States Patent [19]

Guiler et al.

[11] Patent Number: 4,782,613

[45] Date of Patent: Nov. 8, 1988

[54] IDENTIFICATION SEAL FOR ELECTRICIAL CABLE

[75] Inventors: Richard S. Guiler, Newton; Allan W. Swift, Denville, both of N.J.

[73] Assignee: E. J. Brooks Company, Newark, N.J.

[21] Appl. No.: 594,403

[22] Filed: Mar. 27, 1984

[51] Int. Cl.[4] ..... G09F 3/00

[52] U.S. Cl. ..... 40/316; 292/307 A; 292/322; 40/665; 40/667

[58] Field of Search ..... 292/322, 307 A; 40/20, 40/21, 317, 24, 632

[56] References Cited

U.S. PATENT DOCUMENTS

| | | | |
|---|---|---|---|
| 1,139,052 | 5/1915 | Murray et al. | 292/318 |
| 1,150,336 | 8/1915 | Brooks | 40/21 R |
| 1,333,276 | 3/1920 | Murray | 292/318 |
| 3,838,878 | 10/1974 | Fernberg | 292/318 |

*Primary Examiner*—Gene Mancene
*Assistant Examiner*—Wenceslao J. Contreras
*Attorney, Agent, or Firm*—Carella, Byrne, Bain & Gilfillan

[57] ABSTRACT

An identification seal for an electricial cable having resilient insulation on the surface thereof, said seal comprising a flat plastic body retaining a wire shackle. The shackle is provided with a pair of legs for engagement in seal body apertures and has a medial portion connecting the legs which comprises a semi-circular loop portion for gripping the cable, the plane of said semicircular portion being perpendicular to the plane of the shackle legs and the plane of a seal face so that when the seal is assembled onto the cable said face of the seal body is readily visible. Numbers or letters identifying the particular cable may be impressed into the surface of the seal face. The components are so dimensioned that when the seal is assembled onto a cable, the cable is gripped firmly by the loop portion of the shackle to prevent longitudinal or rotational movement of the seal on the cable.

3 Claims, 2 Drawing Sheets

IDENTIFICATION SEAL FOR ELECTRICIAL CABLE

This application is a continuation of application Ser. No. 436,929, filed 10/27/82, now abandoned.

BACKGROUND OF THE INVENTION

In certain electricial installations, it is required that a plurality of electricial cables run from a single source to many different input locations. One example of such an installation is in the cable television industry, where many cables must be run from a junction box to a number of subscribers in the vicinity of the box. In such installations it is often necessary to identify the subscriber to which each cable runs so that the continuity of the cable may be tested in the event of trouble, or so that service may be disconnected in case of non-payment. The identifying means must so secured to the cable that it is readily accessible and with the identifying marks being readily visible, and must be so retained on the cable that it cannot slide laterally nor rotate on the cable. Such identifying means must also be incapable of being removed from the cable and attached to another cable without providing readily visible evidence of tampering.

SUMMARY OF THE INVENTION

A cable identifying seal is provided which comprises a generally flat body formed of a material, such as plastic, which allows letters or numbers to be readily embossed on the surface, and a shackle formed of wire. The shackle has a pair of legs for insertion into seal body apertures so as to be non-removable therefrom without leaving visible evidence of tampering. The shackle is provided with a central loop portion which is so dimensioned that when the loop is assembled onto the cable, the wire of the loop firmly grips the cable throughout more than 180° of the cable circumference and becomes impressed into the cable surface so as to prevent longitudinal and rotary movement of the seal on the cable. The plane of the loop is disposed perpendicular to the plane of the legs and to a seal body surface, so that when the seal is assembled onto the cable, the plane of the face of the seal is parallel to the axis of the cable, the identifying letters or numbers on the face of the seal are easily read, and a number of identifying seals may be placed alongside each other on a cable if it is desired that large letters or numbers be placed on the seal face to enable reading at a distance.

DESCRIPTION OF THE ILLUSTRATED EMBODIMENT

Figure 1:
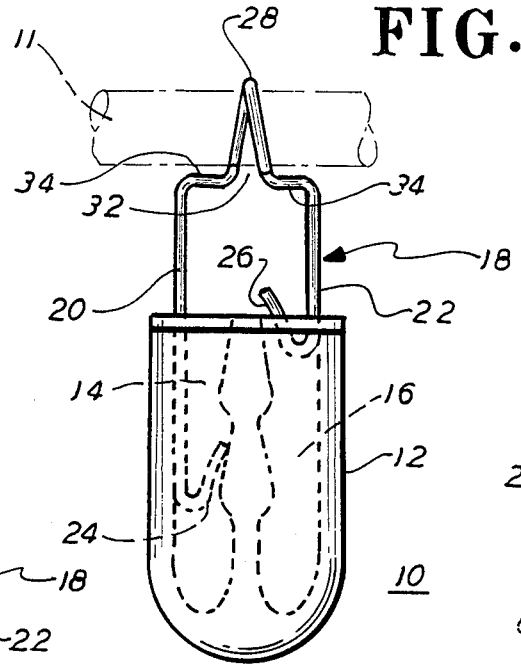
FIG. 1 is a view in side elevation of a cable identifying seal embodying the features of the invention, with the seal being in the condition in which it is supplied to the customer, with the internal structure being shown in dashed lines.
Figure 2:
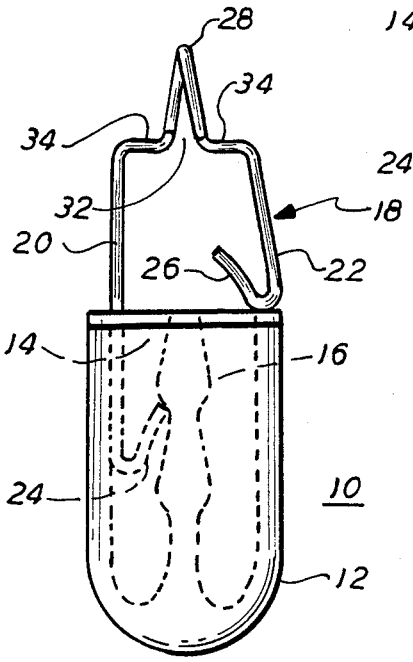
FIG. 2 is a view of the seal of FIG. 1 in which the seal is in condition for use.

Referring to the drawing, there is illustrated an identification seal 10 for application to an electrical cable 11 of the type having an outer surface of resilient insulation. The seal comprises a seal body 12 which is generally thin and rectangular in cross-section with a pair of apertures 14 and 16 in the top surface. A shackle 18 for assembly with the body 12 includes a pair of legs 20 and 22 having reverse bent ends 24 and 26. The reverse bent ends are dimensioned to be received in locking engagement in the apertures 14 and 16.

The seal body 12, the apertures 14 and 16, and the shackle ends, including the bent ends 14 and 16 may have a configuration similar to that of the seal shown in U.S. Pat. No. 3,485,521, so that when the legs are forced into the seal body apertures 14 and 16, the bent ends are flexed toward the leg to which they are attached, and are maintained in said flexed condition by the aperture walls. An outward pull on a leg causes the extreme end thereof to dig into the aperture wall to prevent removal, or, on a stronger pull, to pierce the wall to give visible evidence of tampering.

The upper portion of the shackle 18, in the illustrated embodiment, includes a semi-circular loop portion 28 so positioned as to be centrally disposed above the top of the seal body when assembled, with the plane of said semi-circular loop being generally perpendicular to the plane of the legs and to a face 30 of the seal body, for a purpose to appear hereinafter.

In the preferred embodiment of the invention, the inside diameter of the loop 28 is slightly smaller than the outside diameter of the cable onto which the seal is designed to be assembled, and the loop 28 extends circumferentially more than 180° so that a restricted entrance 32 to the loop is formed which is appreciably narrower than the diameter of the cable.

The seal may be supplied to the user in the condition shown in FIG. 1, in which the longer leg 20 is inserted way into the aperture 14 and the bight 32 between the shorter leg 22 and the reverse bent end portion 26 thereof projects into the aperture 16 to retain the shackle in a semiclosed condition, thereby preventing tangling of the seals when handled in bulk.

Figure 3:
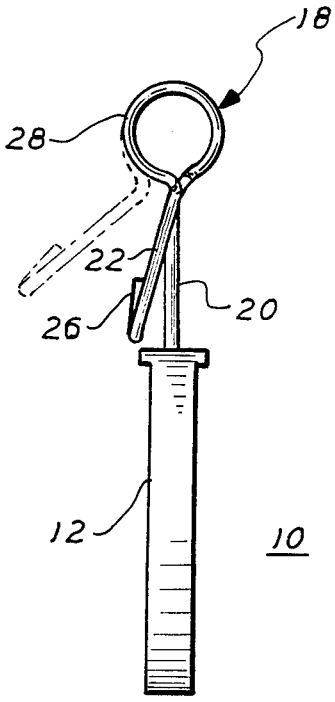
FIG. 3 is a view of the seal of FIG. 2 as seen from the right side.
Figure 4:
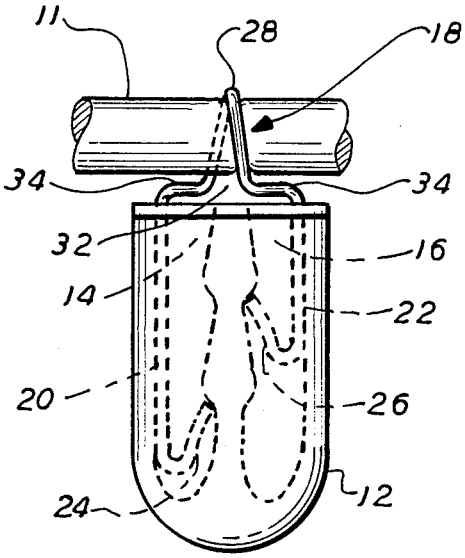
FIG. 4 is a front plan view of the seal assembled onto an electricial cable.
Figure 5:
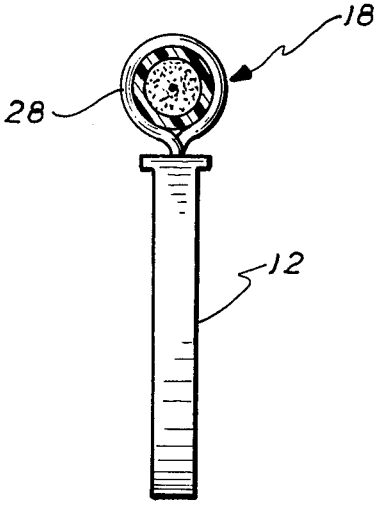
FIG. 5 is a view of the assembly of FIG. 4 as seen from the right side.
Figure 6:
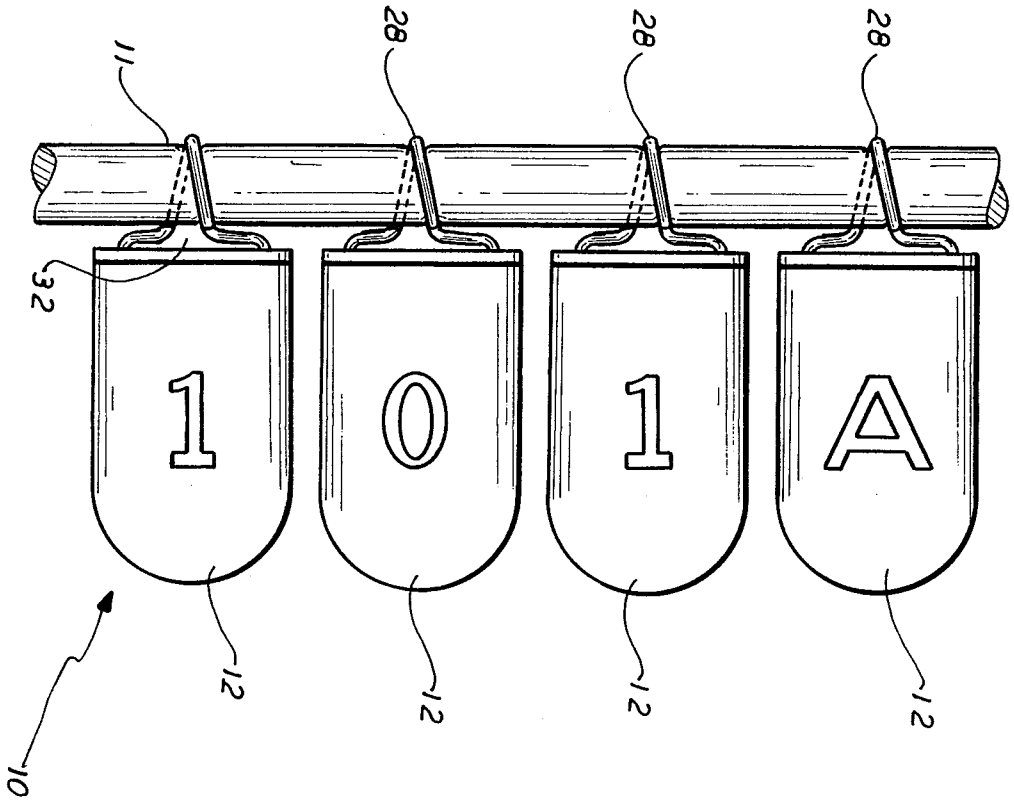
FIG. 6 is a view of a group of seals assembled onto a cable.

When the seal is to be applied to a cable, the shackle is flexed slightly to allow the leg 22 to spring out of the aperture 16 to the position shown in FIG. 3. In a preferred embodiment of the invention, the shackle is so formed that when the leg 22 is released from the aperture, it springs outwardly in relation to the flat face of the seal body. The shackle loop may then be placed around the cable in the desired position by further flexing the leg 22 to the position shown in phantom line in FIG. 3, to assist in snapping the cable through the loop entrance 32. The leg 22 may then be re-inserted into the opening 16 and the entire shackle pushed toward the seal body so that both legs fully enter the seal body apertures and lock therein. The semi-circular portion of the seal thereby grips the cable tightly to prevent to prevent lateral movement of the seal on the cable.

Thereafter the seal may be removed only by cutting the shackle 18. To facilitate such cutting, the portions 34 of the shackle between the legs and the loop are disposed on the top of the seal body in position for cutting by wire cutters.

The fact that the plane of the loop 28 is perpendicular to the plane of the legs 20–22 and to a face 30 of the seal body allows the assembled seal to hang from the cable with the plane of the face 30 parallel to the axis of the cable, so that the letters or numbers on the face of the seal may be easily read to identify the cable, and so that a number of identifying seals may be placed alongside each other on a cable if it is desired that large letters or numbers be placed on the seal to enable reading at a distance.

Although in the illustrated embodiment the seal body if generally thin and rectangular in cross-section, it may have other shapes so long as the body apertures 14–16 and the face 30 are so arranged that the face is in a position generally parallel to the cable when the seal is assembled to allow the seal face to be readily observed when the seal is assembled onto the cable.

Since certain changes apparent to one skilled in the art may be made in the herein described embodiments of the invention without departing from the scope thereof, it is intended that all matter contained herein be interpreted in an illustrative and not a limiting sense.

We claim:

1. An identification seal for a cable having an insulating cover, said seal comprising a seal body formed of deformable plastic, said body being generally thin and rectangular in cross section, and having a side surface for receiving identifying marks and a top surface having spaced apertures extending into the body, and a shackle having a pair of legs with ends shaped and dimensioned for locking engagement in the apertures, said shackle having portions at the upper ends of the legs which are inclined upward and inwardly toward each other to a connecting loop portion, said loop portion having a circumferential extent of greater than 180° forming a restricted entrance to the loop which is smaller than the diameter of the cable onto which the seal is to be assembled, said loop having an inside diameter which is slightly less than the outside diameter of the cable.

2. A seal as set out in claim 1 in which the plane of the loop is perpendicular to the plane of said side surface, whereby when the seal is assembled onto the cable, the side surface carrying the identifying marks is parallel to the cable.

3. An identification seal for a cable having an insulating cover, comprising a seal body formed of a deformable material, said body having a pair of spaced apertures and a face for receiving identification markings, said face being parallel to a plane which passes through said apertures, and a shackle having legs for locking engagement in said apertures, said shackle having a portion which defines a loop having a circumference defined by an angle in excess of 180°, said loop for receiving said cable therethrough and having an inside diameter slightly less than the outside diameter of said cable whereby said loop grips a substantial portion of the peripheral surface of said cable when the seal is assembled, said loop being disposed in relation to said plane that the face of the assembled seal is parallel to the cable.

* * * * *